United States Patent [19]

Wright

[11] 4,284,463

[45] Aug. 18, 1981

[54] WEB PREPARATION APPARATUS

[75] Inventor: Albert L. H. Wright, Sherborn, Mass.

[73] Assignee: Butler Greenwich Inc., Greenwich, Conn.

[21] Appl. No.: 21,211

[22] Filed: Mar. 16, 1979

[51] Int. Cl.[3] ..... B31F 5/00; B65H 69/06

[52] U.S. Cl. ..... 156/502; 83/374; 83/508; 156/159; 156/267; 156/504; 156/505; 156/510; 156/579; 242/58.5; 493/346; 493/363

[58] Field of Search ..... 156/159, 502, 504, 505, 156/506, 510, 523, 579, 157, 267; 242/58.1, 58.3, 58.4, 58.5; 493/346, 363; 83/374, 508

[56] References Cited

U.S. PATENT DOCUMENTS

| | | | |
|---|---|---|---|
| Re. 29,365 | 8/1977 | Butler, Jr. | 242/58.4 |
| 1,156,224 | 10/1915 | Harwood | 83/374 |
| 1,967,748 | 7/1934 | Ehle | 156/523 |
| 2,599,601 | 6/1952 | Axworthy | 83/508 |
| 2,624,408 | 1/1953 | Stein | 83/508 |
| 3,340,131 | 9/1967 | Leibow | 156/579 |
| 3,554,842 | 1/1971 | Byrt | 156/505 |
| 3,981,215 | 9/1976 | Granger et al. | 83/508 |
| 4,039,368 | 8/1977 | Hanke | 156/506 |
| 4,100,012 | 7/1978 | Meihoffer et al. | 156/504 |

*Primary Examiner*—Michael G. Wityshyn
*Attorney, Agent, or Firm*—Cesari and McKenna

[57] ABSTRACT

Web preparation apparatus for use on splicers of the type employing a web positioning bar supporting the leading end of the ready web includes a series of teeth spaced along the length of the preparation bar at one face thereof and a pressing and cutting tool which cooperates with the positioning bar and projections so that when the leading end segment of a ready web is draped over the positioning bar and the tool is engaged to the bar and manipulated in association with the bar, the tool presses a web segment against the face of the bar so as to impale that segment on the teeth thereby removably securing that segment to the bar while simultaneously trimming the web along a line downstream from the impaled web segment.

15 Claims, 6 Drawing Figures

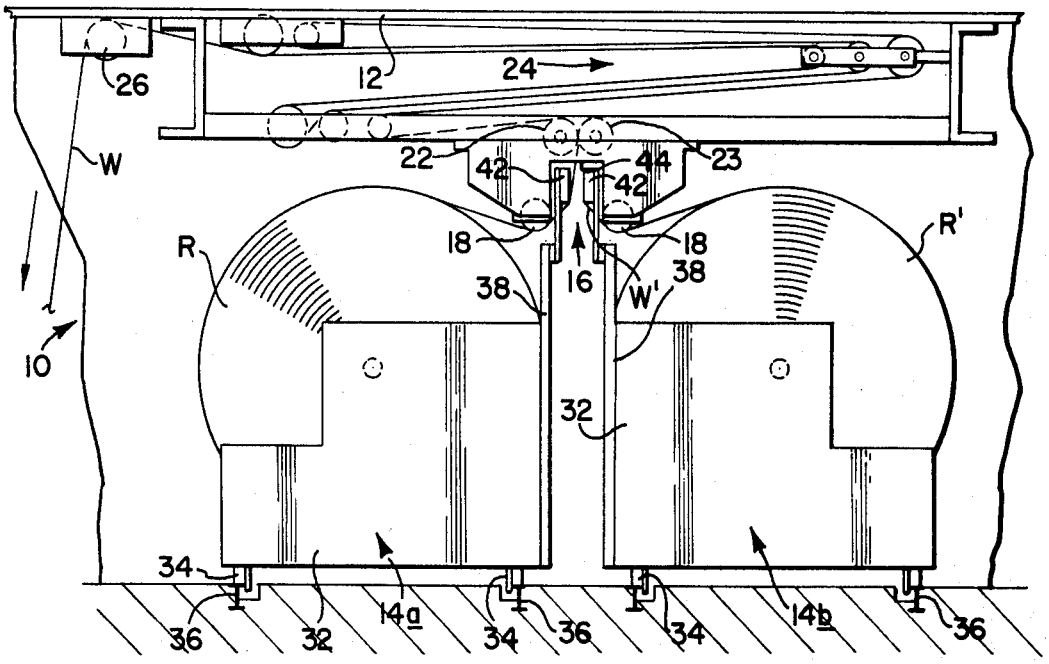
Fig. 1
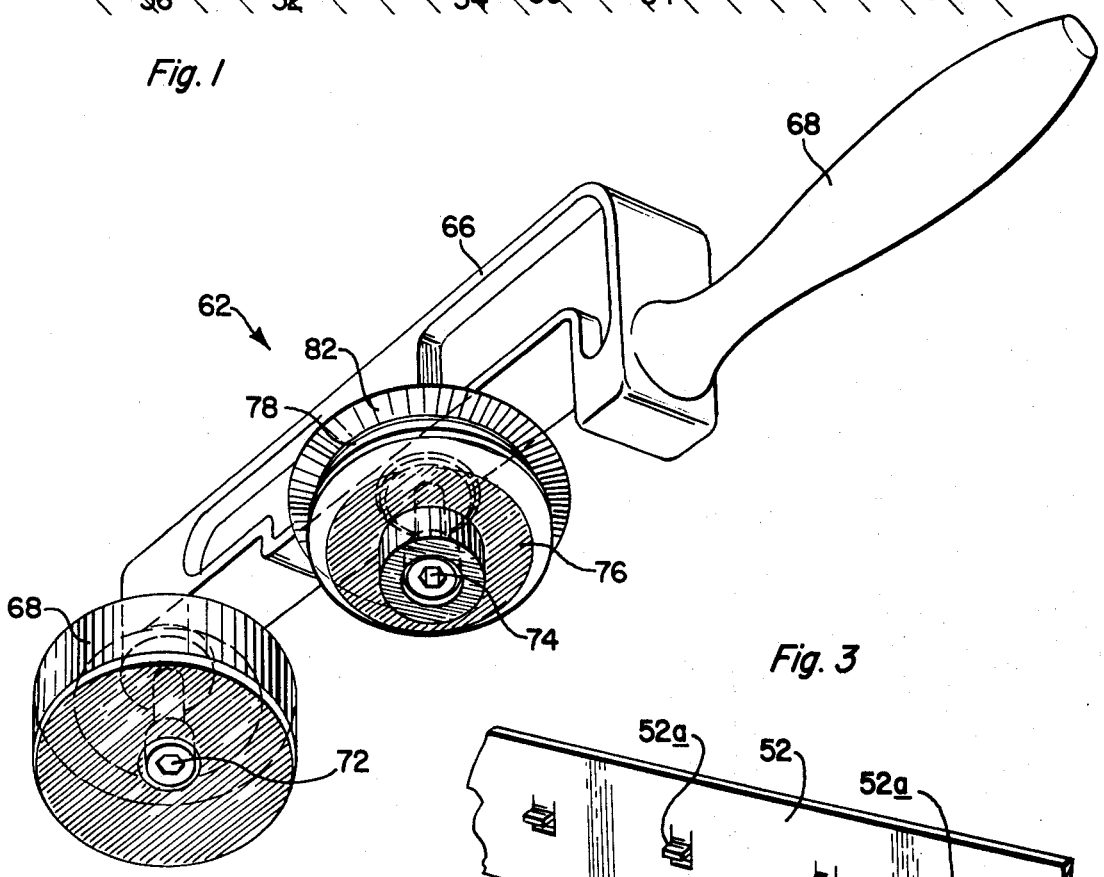
Fig. 4
Fig. 3
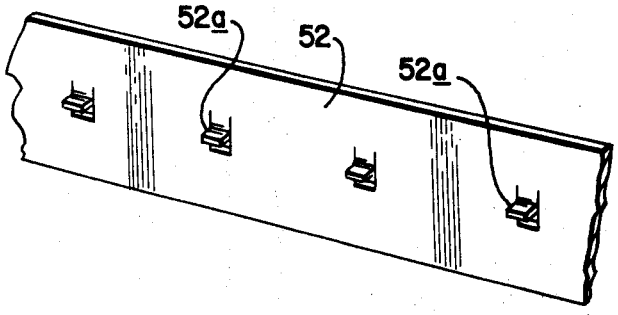

WEB PREPARATION APPARATUS

This invention relates to web preparation apparatus. It relates more particularly to apparatus to facilitate mounting and trimming the leading edge of a ready web in preparation for a splice.

BACKGROUND OF THE INVENTION

When supplying web uninterruptedly to a web consuming machine such as a printing press, for example, it is necessary to draw the web from a succession of rolls. When one web roll is exhausted, the trailing end of the web on that roll is spliced automatically to the leading end of a fresh web roll maintained at the ready. In some splicers, a pair of web rolls are arranged to be mounted underneath the bridge of the splicer. While web is drawn from one roll through the splicing station into the web consuming machine, the leading edge of web from the other roll is prepared for the next splice.

In order to facilitate such preparation, provision is often made for positioning the leading edge of the ready web at an accessible location out from under the splicer bridge. This is done in a variety of ways. Sometimes the web rolls are mounted on roll stands which can be rolled out to positions in front of bridge. Thus while web is drawn from a roll mounted on one roll stand located at the splicing station under the bridge, the other roll stand is rolled out so that a fresh web roll can be mounted on that stand and its leading end prepared for the next splice. Then that stand is rolled back under the bridge to await the next splice station.

If the web rolls are mounted on a so-called fixed stand, the leading end of the ready web can be prepared at an accessible location at an end of the bridge and then carried by suitable transport means into the splicing station prior to the time for making the next splice. These various kinds of splicers are described in U.S. Pat. No. Re. 29,365 owned by the assignee of the present application.

Prior to a splice, the ready horizontal positioning bar is moved to its accessible web preparation position. The leading end of web from the ready roll is aligned with and removably secured to the positioning bar. Next, a strip of double-faced adhesive tape is placed across the exposed face of the ready web end and the end margin beyond the tape is trimmed away. Then the positioning bar is moved back to the splicing station under the bridge so that the positioning bar positions the leading end of the ready web directly opposite the running web so that at the appropriate time the two webs can be pressed together to effect the splice.

Heretofore, two techniques have been used to secure the ready web end margin to the positioning bar prior to the taping and trimming steps described above. In one arrangement, a row of orifices are provided in the positioning bar and a vacuum drawn at those orifices which draws the web end against the bar and maintains its position thereon. That type of arrangement is not too satisfactory because it requires a vacuum pump on each roll stand and fluid-tight connections between the pump and the bar which tend to be relatively expensive. Also the orifices in the bar and the connections thereto tend to be occluded by the web fibers and other debris commonly present in the vicinity of web splicers. As a result, sometimes the web is not securely fastened to the positioning bar across its entire width which may cause a faulty splice.

In other splicing apparatus, the web end margin is secured to the positioning bar by strips of adhesive tape. The web end is aligned with and temporarily clamped to the face of the bar. Then a web end segment projecting above the bar is trimmed away at the bar edge. Next, several short tape strips are applied to the exposed face of the web end at spaced-apart locations thereacross with ends of the strips engaging over and adhering to the top of the bar. Following removal of the clamps, a strip of double-faced adhesive tape is applied to the exposed face of the web just below its leading edge to adhere the ready web to the running web at the appropriate time during a splice sequence.

The cleaning of old adhesive from the bar and the application of all the tape strips to the ready web and bar are tedious and time-consuming tasks. Also, the relative adherances of the short single-face tape strips and the double-faced strip can be quite critical. At the time of splice, the running web should become adhered to the double-faced tape with a sufficiently strong bond that the running web pulls the ready web edge and the short tape segments from the positioning bar. However, that does not always take place. Rather, sometimes the bonds at the double-faced tape give way before the ready web separates from the bar across its full width resulting in a faulty or completely missed splice. Also in many instances, tape strip segments carried along with the ready web adhere to downstream rollers and other machine parts causing tension upsets and marking of the web.

It would be desirable, then, to provide a means for securing the leading end of a ready web to a web positioning bar so that the web end releases properly from the bar across its entire width at the time of the splice and which is easy and inexpensive to implement and to operate.

SUMMARY OF THE INVENTION

Accordingly, it is an object of the present invention to provide web preparation apparatus which positions and secures the leading end of a ready web to a web positioning bar yet permits its reliable release when a splice is to be made.

Another object is to provide a technique for preparing a ready web which can be accomplished quickly and with a minimum number of steps.

Another object of the invention is to provide web preparation apparatus which eliminates the possibility of tape strips being drawn into and through the splicer which could cause downstream web tension upsets.

Yet another object of the invention is to provide web preparation apparatus which simplifies the mounting and trimming of a ready web end in preparation for a splice.

A further object of the invention is to provide web preparation apparatus which can be retrofit on many existing splicers at minimum cost.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

The present invention has equal application to different kinds of splicers employing various types of roll stands, including the fixed type and the roll-out type. It also has application to so-called web rewinders which splice a succession of web lengths for winding on a single roll. For illustrative purposes only, we will describe the invention in the context of a splicer having roll stands of the roll-out type.

In this type of arrangement, the splicer components are supported from an overhead bridge. A pair of mirror image roll stands are arranged to be positioned side by side at a splicing station located under the bridge. While web is being drawn from a web roll mounted on one of the stands to the web consuming machine, the other roll stand can be rolled out in front of the bridge so that a fresh web roll can be mounted on that roll stand and its leading end prepared for the next splice on a positioning bar supported by that roll stand. As soon as the ready web is prepared, that roll stand is rolled back into place underneath the bridge adjacent the roll stand carrying the running web so that at the appropriate time, the leading end of the ready web can be spliced to the trailing end of the running web.

Each roll stand comprises a wheeled base which supports a pair of chocks for engaging a web roll by its core. A pair of spaced-apart standards extending up from the roll stand base support the horizontal positioning bar at an elevated location above the base. The positioning bar is more or less similar to comparable bars found on conventional roll-out stands and depicted in the aforesaid patent. It differs in that it is provided with a long narrow generally rectangular recess in its front face, i.e., the face of the bar that is located directly opposite the similar bar on the other roll stand when the two stands are side by side. The length of the recess is somewhat longer than the width of the web being supported on the roll stand. Projecting out from the bottom or inner wall of the recess is a row of spaced-apart projections or teeth, the lengths of the teeth being more or less the same as the depth of the recess so that the tips of the teeth are more or less coplanar with the front face of the bar.

When preparing the web mounted on that roll stand, the leading end of the web is pulled up around the front face of the positioning bar on that stand and draped over the top of the bar. Once the leading end of the web is properly aligned on the bar, a tool is engaged against the front face of the bar over the web. A part of the tool in register with the groove in the bar presses the opposing web segment into that groove so that the web becomes impaled on the teeth thereby releasably anchoring that edge segment to the bar.

Preferably also the tool includes a knife blade positioned adjacent the tool pressing part on the side thereof closest to the leading edge of the web, which cooperates with a side wall of the groove in the bar to cut the web along that edge of the groove at the same time the web is impaled on the bar teeth. Thus the tool not only removably secures the web to the bar, but also trims away the excess web.

The only remaining step required to be performed to complete web preparation is the application of a strip of double-faced pressure sensitive tape to the exposed face of the web just below the impaled web segment. The roll stand can now be rolled back into position underneath the bridge in preparation for the next splice.

When the splice sequence commences, the running web is slowed or brought to a stop and the web preparation bar supporting the leading end of the ready web and the similar bar located behind the running web are pressed together so that the double-faced adhesive strip adheres to the running web. Following this, the splicer severs the running web upstream from the splice. As the trailing end of the running web thence proceeds through the splicer to the web-consuming machine, it pulls the leading end of the ready web off the teeth on the positioning bar so that web from the ready roll is now drawn into the web-consuming machine. At this point the roll stand supporting the nearly empty core of running web can be moved to its preparation position in front of the bridge and a new roll of web mounted on that stand so that the process can be repeated.

The present apparatus does not require any adhesive or adhesive strips to be affixed to the web positioning bar. Consequently, it eliminates completely the necessity of cleaning adhesive residue from the bar periodically. Further it eliminates the potential problem of adhesive or adhesive strip segments adhering to the moving web and contacting downstream rollers or other machine parts and possibly causing tension upsets and even web breaks. Yet with all of these advantages, the present apparatus enables the leading edge of the ready web to be prepared quite quickly and conveniently so the press operator has more time to devote to other aspects of the press operation. Furthermore, it can be retrofit to existing splicers in the field easily at minimum cost.

BRIEF DESCRIPTION OF THE DRAWINGS

For a fuller understanding of the nature and objects of the invention, reference should be had to the following detailed description taken in connection with the accompanying drawings, in which:

FIG. 1 is an elevational view of splicing apparatus embodying my web preparation apparatus;

FIG. 3 is a similar view of a part of the apparatus;

FIG. 4 is a perspective view depicting another portion of the preparation apparatus in detail;

DESCRIPTION OF THE PREFERRED EMBODIMENTS

Figure 2:
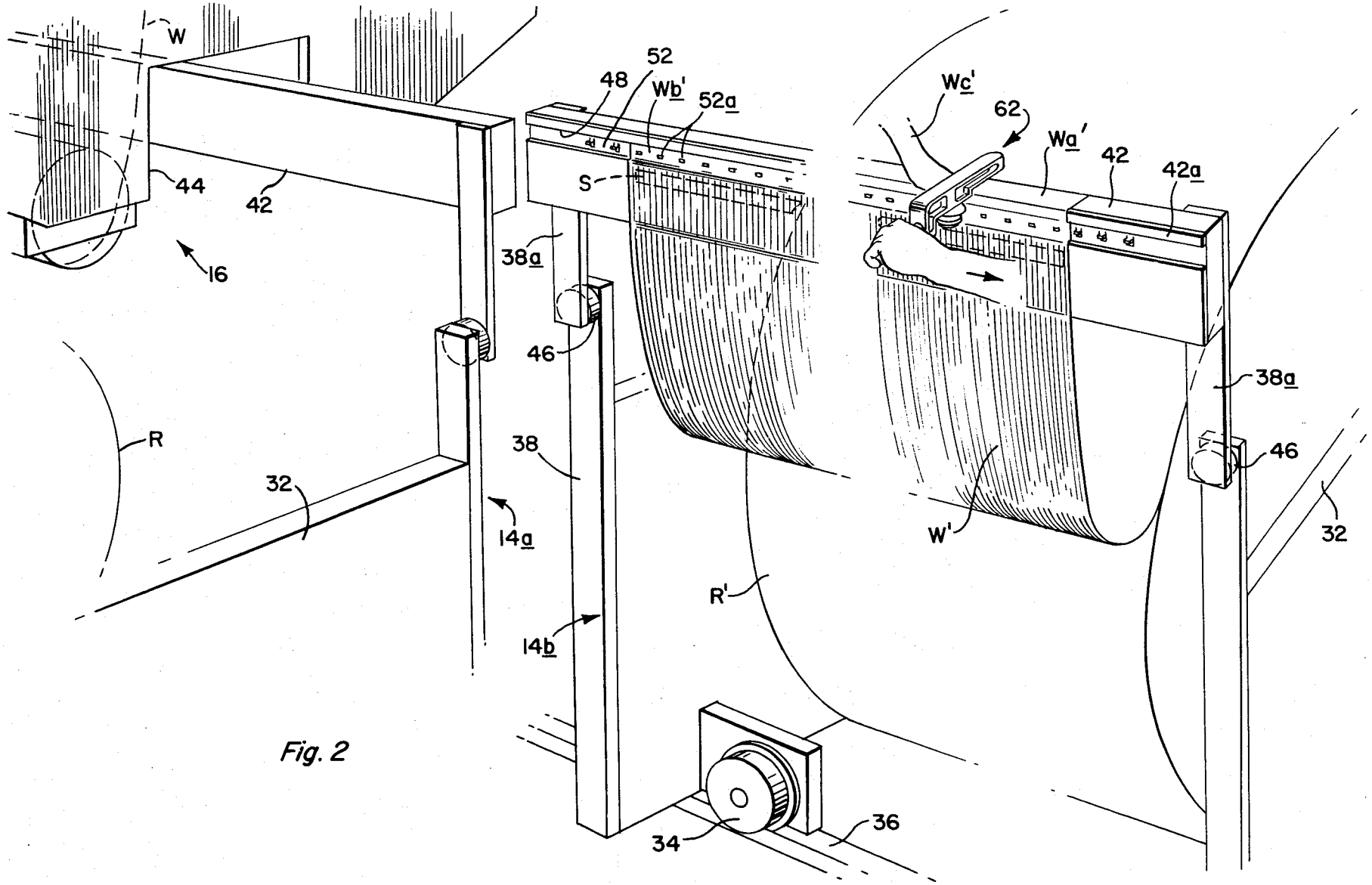
FIG. 2 is a fragmentary perspective view on a larger scale showing the preparation apparatus in greater detail.

Referring now to FIG. 1 of the drawings, splicing apparatus indicated generally at 10 is located under a conventional horizontal bridge 12. A pair of mirror image roll stands 14*a* and 14*b* are positioned adjacent one another underneath bridge 12 just below a splicing station shown generally at 16 suspended from the bridge. Roll stands 14*a* and 14*b* support web rolls R and R′ respectively. Web W from roll R constitutes the running web in this example. The web is trained under a roller 18 at the bottom of the splicing station and extends up through the splicing station and between rollers 22 and 23 into a festoon or accumulator indicated generally at 24 supported by the bridge. The web W leaving the festoon is trained over a roller 26 and thence proceeds to a web consuming machine such as a printing press (not shown).

The roll stands 14*a* and 14*b* are movable from their operating positions illustrated in FIG. 1 to accessible loading positions directly in front of the bridge 12 so that fresh web rolls can be mounted on the roll stands and their leading ends prepared for the next splice. As such, the roll stands 14*a* and 14*b* are of more or less conventional construction and they will not be detailed here. Suffice it to say that each roll stand comprises a base 32 fitted with wheels 34 which ride on tracks 36 recessed into the floor so that each roll stand can be moved from its illustrated operating position to its loading position in front of the bridge. In addition to the usual chocks (not shown) for supporting the web roll, each roll stand includes a pair of spaced-apart standards 38 which support the opposite ends of a generally horizontal web positioning bar 42. As shown in FIG. 1, the splicing station 16 has a relatively large central notch 44 to provide clearance for the standards 38 and positioning bar 42 on the two roll stands as those stands move between their loading and operating positions.

As is customary with splicers of this general type, while web W is being drawn from roll R into and through the accumulator 24 to the web consuming machine, the roll stand 14*b* is moved to its loading station and a fresh web roll R′ is mounted on the roll stand. The leading end of the web W′ drawn from roll R′ is prepared at the positioning bar 42 supported by the roll stand 14*b*. Thereupon that roll stand is moved back into its operative position at the splicing station 16 as shown in FIG. 1 in preparation for the next splice sequence.

Turn now to FIG. 2 which shows a roll stand, i.e., roll stand 14*b* in its loading position in front of bridge 12. A fresh web roll R′ has been positioned on the roll stand and the web W′ is shown being prepared on the positioning bar 42 supported by the standards 38 extending up from that roll stand. Actually each standard comprises a relatively rigid lower section 38 and upper relatively flexible section 38*a* secured to the lower section by a connection 46. This permits the two positioning bars 42 on the two roll stands 14*a* and 14*b* to be moved together when making a splice as will be described later.

The positioning bar 42 is formed with a long rectangular groove 48 in its front face 42*a* facing roll stand 14*a*. The length of groove 48 is longer than the width of the widest web mounted in the roll stand 14*b*. Secured in groove 48 by any suitable means is a long metal strip 52 which is coextensive with the groove. A single row of rectangular teeth 52*a* are spaced along strip 52.

As shown in detail in FIG. 3, each tooth 52*a* is formed by punching a generally rectangular hole in the strip with each tooth constituting the flap of material knocked from the hole. Each tooth 52*a* is formed so that it is flat and lies more or less in a horizontal plane. The length of each tooth 52*a* is such that when the strip 52 is mounted in groove 48, the tips of the teeth lie more or less in the same plane as the positioning bar face 42*a*.

To prepare the web W′ for splicing, its leading end is pulled from the roll so that it drapes down to some extent beside the roll as shown in FIG. 2. Then the end segment $W_a'$ of the web is trained around the front face of bar 42 and over the top of the bar as seen in FIG. 2. Preferably that segment should be aligned in the direction of the roll axis so that its edges are in line with the ends of the roll to minimize wrinkling. Next, the operator engages a tool shown generally at 62 over the top of the positioning bar 42 so that the tool engages the edge margin $W_a'$ extending over that bar. Starting from one end of groove 48, say the left-hand end thereof as depicted in FIG. 2, the tool is drawn along the length of the bar to the opposite end of the groove. In the course of its travel, tool 62 progressively presses a lengthwise web segment $W_b'$ into groove 48 so that that web segment becomes impaled on the teeth 52*a*. At the same time, the tool progressively trims the web at the upper edge of groove 48 as shown in FIG. 2 so that after the tool 62 has traveled the length of groove 48, the web leading edge $W_c'$ is cut away so that the leading end of the web W′ is removably secured to the positioning bar 42 and is trimmed cleanly so that it has a perfectly straight edge as defined by the upper wall of groove 48.

Preparation of the web is completed by applying a strip S of double-faced adhesive tape across the full width of the web W′ just below groove 48 as shown in dotted lines in FIG. 2. The roll stand 14*b* is then rolled back into position at the splicing station 16 to await expiration of the running roll R.

Refer now to FIG. 4 which illustrates the tool 62 in greater detail. It comprises a generally C-shaped frame 66 having a handle 68 secured to one end. A discoid roller 68 is rotatively mounted on a shaft 72 secured to the end of frame 66 opposite handle 68. Also rotatively mounted on a shaft 74 spaced from and parallel to shaft 72 is a second discoid roller 76 which is formed with a circumferential groove or slot 78. Alternatively, in lieu of the groove, a pile or bristled surface can be applied to the peripheral surface of the roller. The spacing between rollers 68 and 76 is slightly greater than the thickness of the positioning bar 42. Also the depth of the slot 78 is slightly greater than the length of the teeth 52*a* on strip 52. Mounted for rotation with roller 76 on the side thereof facing frame 66 is a rotary knife blade 82 whose beveled edge faces the roller 76.

When the tool 62 is placed on bar 42 as shown in FIG. 2 and cocked to some extent in the direction of the length of the bar, the roller 68 engages the rear face of bar 42 while the periphery of roller 76 engages in the groove 48 in the front face thereof, sufficient clearance for the teeth 52*a* being provided by the groove 78. Accordingly the roller 76 presses the web segment $W_b'$ into the groove, thus impaling that web segment on the teeth 52*a*.

Preferably, the teeth 52*a* should be flat and square so that when the web is pressed onto the teeth, the resultant tear in the web is substantially the size of the tooth cross section. This snug fit of the web on the teeth provides optimum retention of the web to the bar. The teeth should not be tapered for best results because, then, the slits punched in the web are oversize or the web segment $W_b'$ is pulled from the teeth by the weight of the web hanging down from the bar to the roll R′. Further, the teeth should be punched from strip 52 so as to leave burrs on the edges of the teeth because the burrs also help to retain the web on the teeth, while permitting the web to be pulled from the teeth at the appropriate time.

As the web is being impaled on the teeth, the rotary knife blade 82 engages in groove 48 just under its upper edge so that that edge and the blade positioned on opposite sides of the web cooperate to shear the web and trim away the edge strip $W_c'$ as the tool 62 is drawn along the bar 42. Consequently the tool 62 constitutes a very simple, inexpensive and convenient device for simultaneously securing the leading edge of the web to bar 42 and trimming the web edge. One that has been done, the double-faced adhesive strip S can be applied to the exposed face of the web just below groove 48 as described above.

Figure 5:
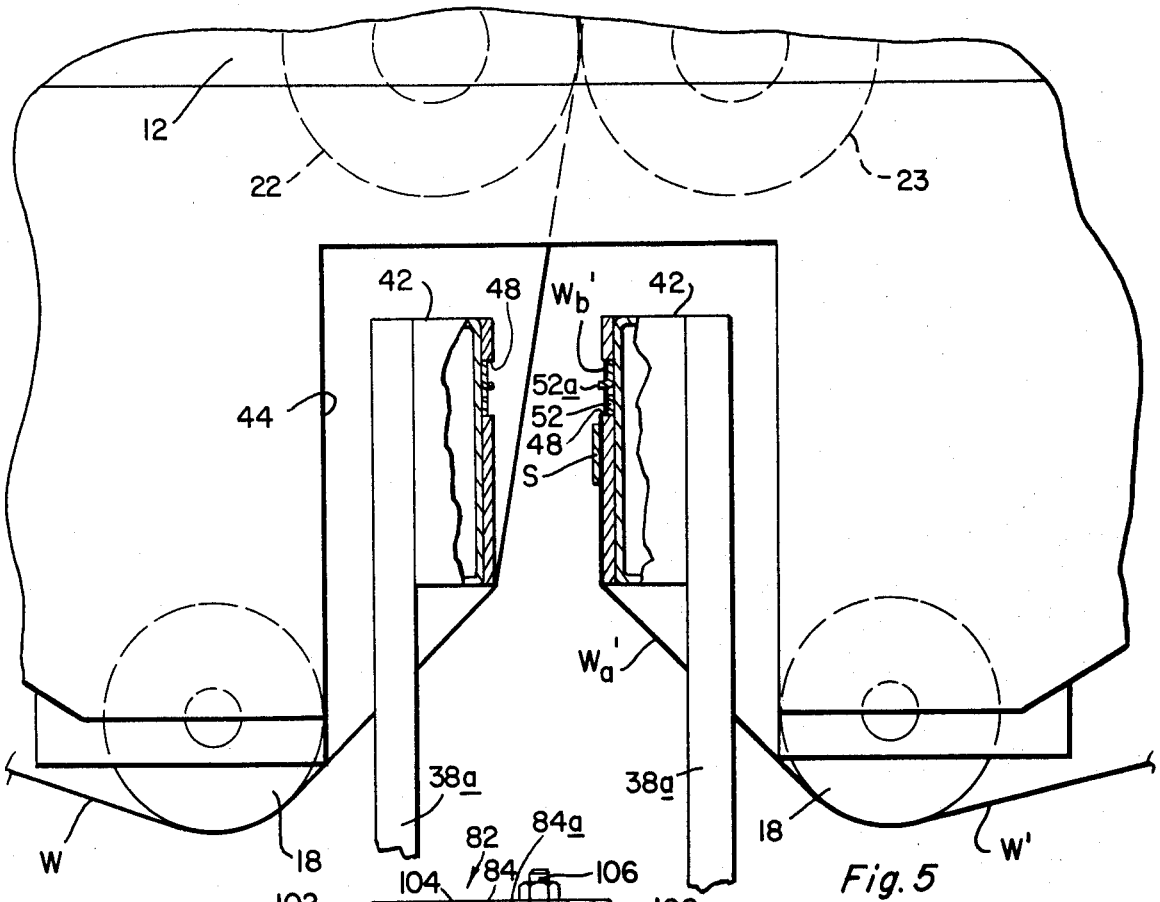
FIG. 5 is a fragmentary elevational view showing a portion of the FIG. 1 apparatus in detail.

Turning now to FIG. 5, after the leading end of the ready web W′ has been prepared as described above and the roll stand 14*b* is repositioned at the splicing station 16, the positioning bars 42 on the two roll stands 14*a* and 14*b* are located on opposite sides of the running web W as shown in FIG. 5. At this point, the bars 42 are spaced apart so that the running web is free to travel between them. Also in its travel from the roller 18 to the roller 22, the running web is inclined at an angle relative to the bar 42 on the roll stand carrying the running roll R so that the running web does not contact the teeth 52*a* on that bar. Further as seen in FIG. 4, the leading end segments $W_a'$ secured to the bar 42 on the ready roll stand has the double-faced adhesive strip S extending across its full width disposed directly opposite the running web at a location just below the grooves 48 on the two bars 42.

When the running roll R is about to expire, the splice sequence is initiated manually or automatically. The running web is thereupon slowed or brought to a standstill. Then, means (not shown) are actuated which press the two positioning bars 42 together, the upper standard sections 38*a* being sufficiently flexible to permit this. When that occurs, the adhesive strip S adheres to the opposing face of the running web. Since the teeth 52*a* on the two bars are recessed into grooves 48 when the two bars are pressed together, those projections do not penetrate the running web, nor do they interfere with each other. As an added precaution against such interference, the teeth on one positioning bar 42 can be situated slightly below those on the other.

Then a cutter (not shown) at the splicing station 16 severs the running web W upstream from the positioning bar 42 on roll stand 14*a*,i.e. between roller 18 and bar 42. Thereupon, the running web is accelerated up to line speed such as by driving roller 22. The running web thereupon pulls the leading end segment $W_b'$ of the ready web adhered to it away from the teeth 52*a* that held it to bar 42 and the web W' is thus drawn through the festoon 24 (FIG. 1) to the web consuming machine. During the splice sequence when the web is slowed or stopped, the considerable length of web maintained in festoon 24 (FIG. 1) supplies the needs of the web-consuming machine so that web proceeds uninterruptedly into that machine.

The tool 62, instead of being manually operated, could just as well be permanently mounted on or adjacent to each positioning bar 42. For example, a tool similar to tool 62 could be arranged to ride along a pair of tracks formed on the positioning bar 42, one track constituting the upper edge of the groove 48 along which the rotary cutter 82 rides, the other track being formed at the rear face of the bar and arranged to coact with a circumferential rib or groove in roller 68. In that event, the tool could be drawn automatically across the bar using ay convenient transport means such as a cable or chain.

Figure 6:
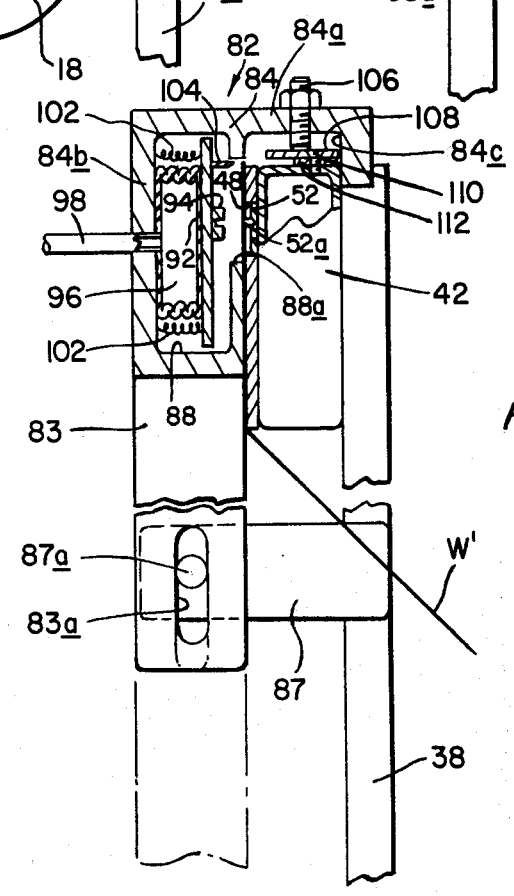
FIG. 6 is a fragmentary elevational view with parts in section of a modified embodiment of my web preparation apparatus.

A simpler arrangement is depicted in FIG. 6. Here a tool indicated generally at 82 is hingedly mounted on the roll stand. The tool can be swung from an out-of-the-way position shown in dotted lines wherein it hangs down from standards 38 and does not interfere when the roll stand is located under the bridge 12 to a solid line position when the roll stand is positioned in front of the bridge in order to prepare the ready web.

The tool 82 comprises a housing 84 which extends substantially the entire length of positioning bar 42. The opposite ends of the housing are connected to a pair of arms 83 whose ends are provided with lengthwise slots 83*a*. Pivots 87*a* projecting laterally from ears 87 secured to standads 38 engage in those slots so that the housing 84 is pivotally secured to the standards and can be lifted up and engaged over the top of bar 42 as shown in FIG. 6.

Housing 84 is generally L-shaped in cross section. One leg 84*a*. of the housing is formed with a lengthwise groove 84*c* which is slightly wider than the thickness of bar 42 so that when the housing is engaged over the bar as shown in FIG. 6, the upper edge of the bar is received in the groove 84*c*. The other leg 84*b* of the housing is formed with a lengthwise generally rectangularly passage 88 having a mouth or opening 88*a* facing bar 42 when the tool is engaged over the bar. Positioned in the opening 88 is a long, generally rectangular, rigid bar 92 which supports a grooved block or stiff brush 94 which projects through mouth 88*a* toward the groove 48 on bar 42. Positioned between bar 92 and the bottom wall of opening 88 is a long inflatable bladder or bellows 96. When air is introduced into the bladder by way of a conduit 98 connected to a suitable source (not shown) of pressurized air, the bladder pushes the strip 92 and the grooved block or brush 94 into the groove 48 in bar 42. When the air pressure in the bladder is relieved, springs 102 retract the block 94 from groove 48. Also projecting out from strip 92 directly above brush 94 is a long, preferably serrated, knife blade 104.

In order to properly position the housing 84 relative to bar 42 when the tool 82 is engaged over the bar, a set screw 106 is threaded through the top wall of the housing leg 84*a*. The end of that screw bears against a strip 108 secured to the top wall of bar 42 by a lengthwise series of screws 110. Also a suitable spacer 112 may be positioned between the bar 42 and strip 108 to add extra height to the bar. When the set screw 106 is properly set, the block or brush 94 is positioned directly opposite groove 48 and the knife blade 104 is positioned directly opposite the corner of bar 42.

To prepare the web W', its leading end $W_a'$ is draped over the bar 42 as described above. Then the tool 82 is engaged over the top of the bar as shown in solid lines in FIG. 6. Next the bladder 96 is inflated which projects the block or brush 94 into the groove 48 thereby impaling the web segment $W_b'$ onto the teeth 52*a* in that groove. Simultaneously the knife blade 104 severs the web just above segment $W_b'$. Next, the tool 82 is disengaged from the bar and lowered to its ready position shown in dotted lines in FIG. 6 and a strip of adhesive tape is applied to the exposed face of the web just below segment $W_b'$ completing the preparation operation. Finally, the roll stand is moved back to the splicing station 16 under bridge 12 to the position illustrated in FIG. 1 to await the next splice sequence.

It will be seen from the foregoing, then, that my web preparation apparatus simplifies considerably securing the leading end of a ready web to a positioning bar and trimming that end in preparation for a splice. The apparatus eliminates the requirement of applying adhesive or adhesive tape to the preparation bar which can cause problems downstream from the splicing apparatus. It also reduces the number of operator steps required to prepare the web. Yet the apparatus is quite simple and inexpensive and it can be retrofit on existing splicing apparatus in the field without requiring extensive down time of that equipment. Consequently, it should find wide application wherever web unwinders and rewinders are employed.

It will thus be seen that the objects set forth above, among those made apparent from the preceding description are efficiently attained and since certain changes may be made in the above description without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. In a splicer of the type having a splicing station, a web preparation station and a web positioning bar movable between the two stations, web preparation apparatus comprising A. a series of projections spaced alone the length of the positioning bar at one face thereof, and B. a tool engageable against the positioning bar after the leading end segment of a ready web is draped over the bar, said tool having means for pressing the draped web segment against said face of the bar so that said web segment becomes impaled on said projections thereby removably securing said web segment to said bar.

2. The web preparation apparatus defined in claim 1 wherein the roots of said projections are recessed into said bar face and the tips of said projections are more or less coplanar with said bar face.

3. The web preparation apparatus defined in claim 2 wherein each said projection is in the form of a generally rectangular tooth which extends generally perpendicular to said bar face.

4. The web preparation apparatus defined in claim 1 wherein the pressing means includes a brush substantially coextensive with said projection series.

5. The web preparation apparatus defined in claim 1 wherein said tool comprises A. A bracket, B. retaining means secured to the bracket, C. cutting means secured to the bracket, D. a roller having a circumferential groove, and E. means for rotatively securing the roller to the bracket so that the periphery of the roller is spaced from the retaining means a distance approximately equal to the thickness of the positioning bar whereby when the bracket is placed over the positioning bar with the roller and retaining means engaging against opposite faces of the bar and the bracket is drawn alone the length of the bar, said roller presses said web segment onto said projections, said projections being received in the groove in said roller and said cutting means trims off the leading edge of said web.

6. The web preparation apparatus defined in claim 5 wherein the retaining means comprises a second roller.

7. The web preparation apparatus defined in claim 5 wherein the cutting means includes a rotary knife blade positioned between the bracket and said roller and mounted for rotation with said roller so that when the bracket is drawn along the bar, th blade cuts the web along a line adjacent to the web segment impaled on said projections.

8. The web preparation apparatus defined in claim 1 wherein said tool also includes a cutter on the side of the pressing means closest to the leading edge of said web segment so that as said pressing means impales said web segment on said projections, the cutter trims away the leading edge of said web.

9. The web preparation apparatus defined in claim 1 wherein said tool comprises A. a housing whose length is commensurate with the length of the positioning bar;

B. means for swingably supporting the housing so that the housing can be swung from an out-of-the-way position to an operative position engaging against the positioning bar;

C. cutting means secured to the housing,

D. pressing means secured to the housing, said pressing means extending substantially the entire length of the series of projections on the positioning bar, and E. means for moving the pressing means against the positioning bar when the bracket is in its operative position so that the pressing means impales said web segment on said projections.

10. The web preparation apparatus defined in claim 8 wherein the cutter includes a knife blade mounted adjacent to the pressing means, said knife blade having a length commensurate with the length of the series of projections on said bar, and being advanced toward the bar by said pressing means.

11. The web preparation apparatus defined in claim 9 wherein the pressing means includes a grooved block and an inflatable capsule located between a housing wall and said block so that when the capusle is inflated the capsule pushes the block against said projections.

12. The web preparation apparatus defined in claim 9 wherein the pressing means includes a brush and an inflatable capsule located between a housing wall and said brush so that when the capsule is inflated the capsule pushes the brush against said projections.

13. In a splicer of the type having a splicing station and an elongated web positioning means located at the splicing station, web preparation apparatus comprising A. a series of projections spaced along the length of the positioning means, and B. a tool engageable against the positioning means after the leading end segment of the ready web is located at the positioning means, said tool having means for pressing the web segment against said positioning means so that said web segment becomes impaled on said projections, thereby removably securing said web segment to said positioning means.

14. Web preparation apparatus defined in claim 13 wherein said projections are recessed into said positioning means.

15. Web preparation apparatus for use in a splicer having a splicing station and elongated web positioning means located at the splicing station which positioning means has a series of projections, said apparatus comprising A. a bracket, B. retaining means secured to the bracket, C. a roller having a circumferential groove, D. a circular knife blade mounted coaxially to the roller, and E. means for rotatively securing the roller and knife blade bracket so that the peripheries of the roller and blade are spaced from the retaining means a distance whereby, when the bracket is placed against the positioning means with the roller, and blade and the retaining means engaging opposite surfaces of the positioning means and the bracket is drawn lengthwise along the positioning means, said roller presses a web end segment located at the positioning means onto said projections, said projections being received in the groove in said roller, while said knife blade trims off the leading edge of said web.

* * * * *